US006402352B1

(12) United States Patent
Summerford et al.

(10) Patent No.: US 6,402,352 B1
(45) Date of Patent: Jun. 11, 2002

(54) ROTATABLE HOUSING FOR A POST TOP-MOUNTED LIGHT FIXTURE

(75) Inventors: Robert L. Summerford, Schertz; Claude Barozzini, Austin; Henry M. Glover, New Braunfels, all of TX (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/276,337

(22) Filed: Mar. 25, 1999

(51) Int. Cl.[7] ..... F21S 8/00

(52) U.S. Cl. ..... 362/426; 362/431; 362/427; 362/426; 362/371; 362/430; 362/372; 362/269

(58) Field of Search ..... 362/419, 426, 362/427, 430, 431, 457, 414, 371, 372, 365, 269

(56) References Cited

U.S. PATENT DOCUMENTS

| | | | | | |
|---|---|---|---|---|---|
| 3,543,016 | A | * | 11/1970 | Jones | 362/426 |
| 4,090,210 | A | | 5/1978 | Wehling et al. | 362/419 |
| 4,143,413 | A | | 3/1979 | Kelly | 362/418 |
| 4,164,784 | A | * | 8/1979 | Jaksich | 362/282 |
| 4,480,809 | A | | 11/1984 | Healey | 248/185 |
| 4,527,224 | A | * | 7/1985 | Sangiamo | 362/282 |
| 4,626,975 | A | | 12/1986 | Miletich | 362/418 |
| 5,140,507 | A | | 8/1992 | Harwood | 362/271 |
| 5,183,331 | A | * | 2/1993 | Edgell et al. | 362/426 |
| 5,450,303 | A | | 9/1995 | Markiewiczz et al. | 362/419 |
| 5,826,975 | A | * | 10/1998 | Hsieh et al. | 362/414 |

* cited by examiner

*Primary Examiner*—Sandra O'Shea
*Assistant Examiner*—Ali Alavi
(74) *Attorney, Agent, or Firm*—Jeffrey A. Haeberlin; Middleton Reutinger

(57) ABSTRACT

A light fixture comprising a rotatable housing, a mounting yoke and a mounting fixture for securing the housing directly to the top of a hollow post to permit the housing to be directed straight down or at a tilt angle to either side. The housing includes integral or insertable axle portions that protrude from either side of the housing. The top of each side of the yoke includes a support casting with an opening for receiving the respective protruding axle portions of the housing. Matching indicia on the end of at least one of the axle portions and the receiving casting hub provide degree of tilt information. Wiring from the power source coming out of the top of the post progresses through one or more appropriate channels in the yoke, through the appropriate casting and through an accommodated protruding axle portion. The yoke is preferably comprised of at least one tubular member. The mounting fixture in the form of matching top and base plates mounts the center brace portion of the yoke to the top of the post.

28 Claims, 3 Drawing Sheets

FIG. 1
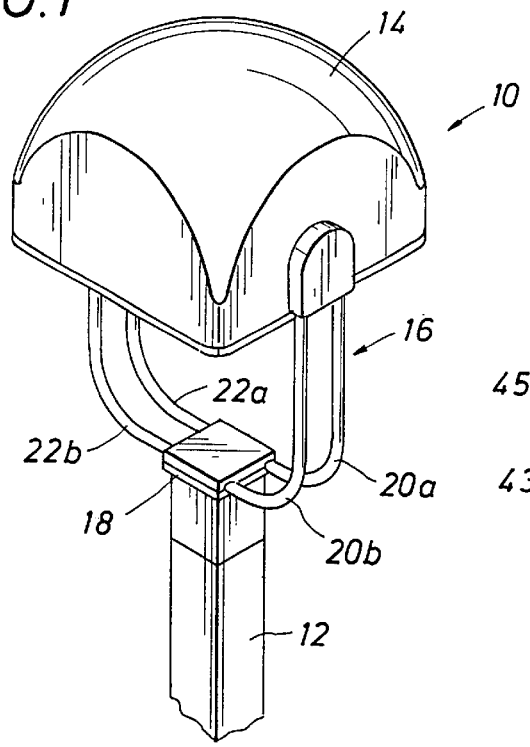
FIG. 2
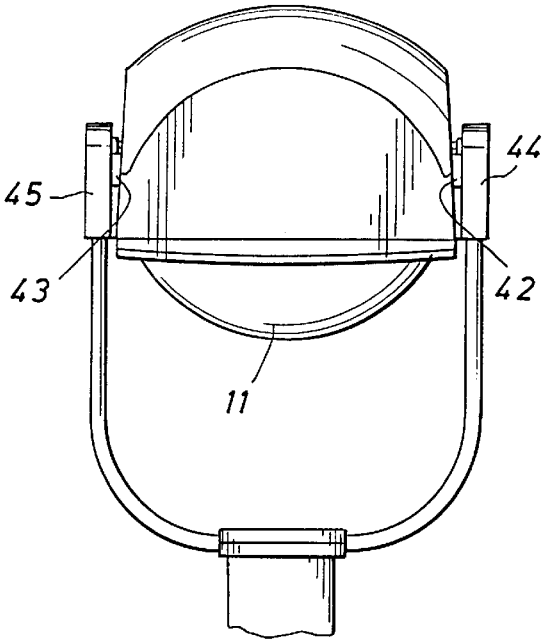
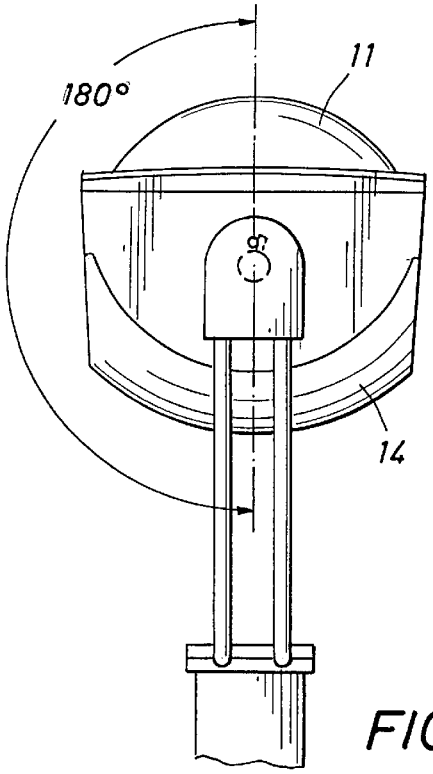
FIG. 3
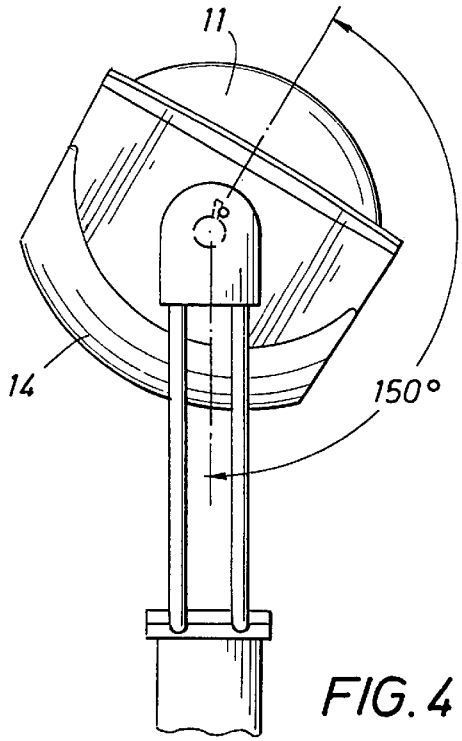
FIG. 4

ROTATABLE HOUSING FOR A POST TOP-MOUNTED LIGHT FIXTURE

BACKGROUND OF THE INVENTION

1. Field of the Invention

This invention pertains to pole mounted lighting fixtures and more particularly to lighting fixtures that are mounted directly over the top of a mounting pole.

2. Description of the Prior Art

Lighting fixtures can be mounted a number of different ways to an independent or free-standing pole away from or on top of any associated structure. For example, street lights have perched lights atop of free-standing poles and enclosed with a frosted glass or plastic housing through which light emanates in all directions. When it has been desired to shield the light emanations, it has been popular to use an arm at the top of the pole and to utilize an opaque housing to prevent light from reflecting upwardly and to aim the light from the fixture in a specific primary direction. Such a light can also conveniently be swivelly hinged on the end of such an arm for adjustable tilting. If it is desired to obtain universal lighting straight down around the mounting pole, rather than off to one side, it has been common to either include a shade or opaque housing over a centrally mounted single light source or to include two or more lights mounted on arms at symmetrical locations around the top of the pole. Although it is possible to hinge the lights in a multiple-arm installation, it has not been heretofore convenient to have the advantage of a single light source in a fixture that can be directed straight down to provide universal light, and which also can be conveniently rotated or tilted to provide light aimed in a specific primary direction or away from an area location.

It is also common for aimable floodlight fixtures to have physical differences between the housing of the aimable fixtures and the housings of associated fixed area floodlight fixtures. Typically, the aimable fixtures must be mounted to the side or middle of the light posts, or possibly on the ground, whereas the fixed area fixtures are mounted in a different manner. Such differences prevent the option of having all the fixture housings match in shape and mounting appearance.

To make a fixture aimable, one means that has been employed in the prior art has been a large swivel hinge connected to a single light at the top of a mounting pole. In such a case, the electrical wiring passes from the top of the pole to the base of a light fixture either through the hinge or next to it; however, such a connection has several shortcomings. First, the wiring is either exposed to the elements or subject to fatigue as the swivel hinge is rotated. Second, the swivel hinge usually allows a heavy fixture to droop over a period of time. It is also subject to corroding in place with weather exposure so that it cannot be conveniently rotated in the future. Third, the wiring into the base of such a fixture makes it necessary to vertically position the lamp within the fixture, when many times it is desirable to horizontally orient the lamp since the housing behind a horizontally orientated lamp more conveniently aims the light emanations. It is possible to avoid a swivel hinge by having a lighting fixture that can be wired through different portals into the housing, but such a mounting requires rewiring in order to change the tilt or aiming angle of the fixture.

Therefore, it is a feature of the present invention to provide an improved lighting fixture that can be conveniently rotatably mounted atop of a light pole so the lamp can be mounted vertically, horizontally, or at an angle and so that the rotation mechanism does not have the aforementioned disadvantages of a swivel hinge.

It is another feature of the present invention to provide an improved lighting fixture that is adjustably mounted at the top of a pole not using a swivel hinge and that does not require rewiring in order to adjust the tilt or aiming angle of the fixture.

It is another feature of the present invention to provide the option of utilizing aimable floodlighting optics in the improved lighting fixture in addition to area floodlighting optics, so that all fixtures aesthetically match in both shape and installation location.

SUMMARY OF THE INVENTION

The present invention provides for mounting a lighting fixture having a generally horizontally oriented reflector therein atop a vertical, hollow mounting post utilizing a mounting yoke connected to opposite sides of the housing. The reflector is secured within the housing for reflecting the light source in a desired pattern. The socket or other lamp connector can be located so as to orient the lamp horizontally, vertically, or at an angle within the reflector, as desired. The housing of the preferred embodiment has tubular portions that protrude sideways from the housing on either side thereof and form the ends of a rotatable axis that fits into respective receiving openings of side supports of a mounting yoke. A protruding housing tubular portion may be either solid or hollow, depending on the connection with a respective side support of the yoke. A tubular portion may also be integral with the housing or externally connected to the housing using a threaded or similar secure connection means.

At least one tubular portion has an opening to receive electrical wiring that supplies power to the lamp in the housing. In addition to the two side supports, the yoke includes a brace therebetween having at least one substantially rigid pipe for the electrical wiring passing from the hollow mounting pole to the opening in a tubular portion of the housing for connection to the lamp. A mounting fixture with a base plate connects the brace of the yoke and protects the power wiring as it leaves the top of the pole. A casting cover of the first yoke support protects the wiring from the top of the wiring pipe as it passes into the axle end of a protruding tubular portion of the housing. The cover also protects the axle tubular end from outside elements. An identical casting cover protects the axle end of the other protruding portion of the housing and the exposed end of the second yoke support. A set screw operable through one or both covers holds the light fixture housing at a predetermined tilt or aiming angle with respect to the side supports. Thus, in order to reset the angle, one only needs to loosen the screw or screws and change the angle, as desired, before re-tightening the setscrew(s).

The set screw also functions to secure the casting cover to the housing, and thus the mounting yoke. In the preferred embodiment at least one of the tubular portions has a groove around its outside periphery wherein a safety spring pin fixedly secures its accommodating yoke side support to such tubular portion as a safety backup to the set screw connection. The safety spring pin/groove connection allows the tubular portion, and thus the housing, to rotate or tilt with respect to the side supports. For more precision, the covers of the supports can be removed and a matching indicia on at least one of the axle ends and the hub opening of the support in which such axle end rotates can be used to set the angle before replacing the cover(s) and setscrew(s).

The adjustability of the fixture eliminates the need for making any new electrical connection merely to change the angle of tilt. The housing may be swung through a wide range of possible angles that include a range of about 0–180° to one side and a range of about 0–150° to the other. Appropriate stops are employed to establish the extreme end of the respective rotation ranges. In the preferred embodiment, the housing has a metal piece protruding from the side of the housing to engage a raised section of the first support facing the housing, such that the metal piece prevents rotation when engaged with the raised section. The metal piece may be a projection integral to the housing, a screw threaded into the housing, a washer having a bent tab secured to the housing, or other convenient stop structure.

BRIEF DESCRIPTION OF THE DRAWING

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

In the drawings:

FIG. 1 is an elevated perspective of a rotatable housing for a post top-mounted light fixture in accordance with a preferred embodiment of the invention.

FIG. 2 is a front view of the light fixture shown in FIG. 1.

FIG. 3 is a side view of the light fixture shown in FIG. 1 illustrating a rotation of the housing to 180° in a first direction.

FIG. 4 is a side view of the light fixture shown in FIG. 1 illustrating a rotation of the housing to 150° in a second direction.

DESCRIPTION OF THE PREFERRED EMBODIMENT

Figure 5:
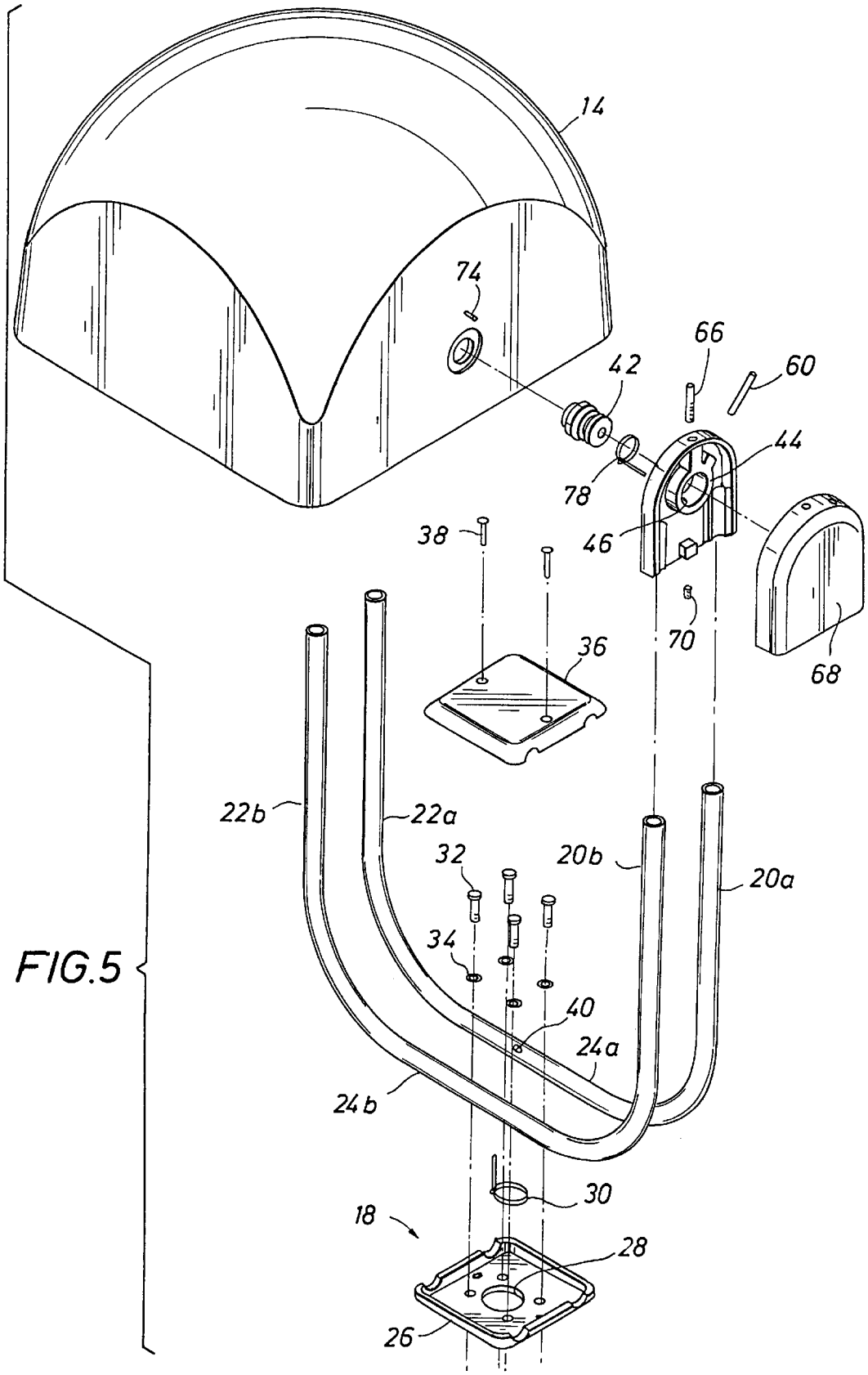
FIG. 5 is an exploded view of the light fixture shown in FIG. 1.

Now referring to the drawings, and first to FIG. 1, a light fixture 10 is shown mounted atop a post 12 in accordance with a preferred embodiment of the invention. Light fixture 10 generally comprises a housing 14, a mounting yoke 16 and a mounting fixture 18. As shown in FIG. 1, housing 14 is positioned directly over post 12 so that the reflector system and light lamp within housing 14 directs the light emanating from the housing through lens 11 in a downwardly direction to be substantially uniformly distributed around the base of the post. The reflector system and lamp can vary in structure, many of which are well-known in the art. Generally, however, the reflector or system of multiple reflectors is fixedly secured inside the housing and oriented to reflect light from one or more lamps in a predetermined pattern. The typical high intensity discharge light lamp has an elongated axis and is connected to a socket that positions the lamp axis horizontally approximately with an elongate axis of the reflector system. Although in some embodiments the connector in housing 14 positions the lamp or plurality of lamps considered together as a light source in alignment with the rotatable axis of the housing as established by its mounting within the mounting yoke, as described below, it is preferred that the connector in housing 14 positions the elongate axis of the lamp or plurality of lamps so as to be not exactly parallel with the rotatable axis of the housing.

Mounting yoke 16 conveniently is made of tubular components and includes a first support comprised of rigid pipes 20*a* and 20*b* attached to one side of housing 14 and a second support comprised of rigid pipes 22*a* and 22*b* attached to the opposite side of the housing. As best shown in FIG. 5, pipe 20*a* is joined to pipe 22*a* in a rigid brace section 24*a* and pipe 20*b* is joined to pipe 22*b* in a rigid brace section 24*b*. In the preferred embodiment illustrated, straight upper pipes 20*a* and 22*a* form an integral tubular entity with U-shaped pipe section 24*a* and straight upper pipes 20*b* and 22*b* form an integral tubular entity with U-shape pipe section 24*b*.

Mounting fixture 18 is preferably comprised of a bottom or base plate 26 having a central orifice 28 through which electrical wiring is received from the inside of the mounting post, the wiring coming from a power source (not shown) in a manner well-known in the art. As is shown, base plate 26 includes indentions for partially surrounding tubular sections 24*a* and 24*b* to hold them in place during installation. A tie wrap 30 attaches to base plate 26 to strain relieve the wires passing through the orifice. Base plate 26 includes holes for receiving mounting screws 32 so that the base plate can be secured to the top of post 12 through matching internally threaded holes therein. Lock washers 34 are preferably employed with screws 32. Post 12 may alternatively have a threaded mast fitter attached to top of post, or other such mounting mechanisms that are common in the art.

Mounting fixture 18 also includes a top plate 36 with complementary indentions to fit over pipes 24*a* and 24*b*. Base plate 26 and top plate 36 are of matching peripheral dimension, the complementary indentions allowing the respective edges of the plates to abut when in their installed positions. Screws 38 secure top plate 36 to the base plate by passing through holes in the top plate and screwing into aligned threaded holes in the base plate.

As further described below, wiring from the post passes up through orifice 28, through an opening 40 in pipe section 24*a,* through pipe 20*a,* out of the top of pipe 20*a* into an axial opening in a protruding portion 42 of the housing. In FIG. 5, portion 42 is shown as a separate piece that is secured in a side opening of the housing. Alternatively, it can be integral with the housing and protrudes from the housing for purpose of allowing rotation, as hereafter described. It is further noted that the wiring is shown passing through only one of the four pipes of the mounting yoke. Alternatively, the wiring can pass through both pipes attached to one side of the housing or through one or both pipes attached to both sides of the housing, if desired.

Figure 6:
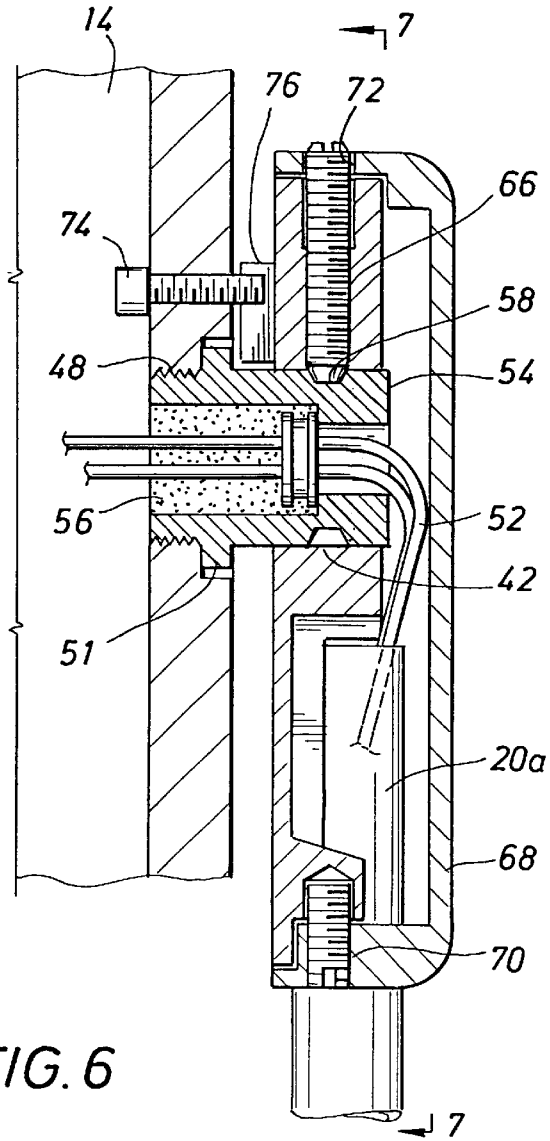
FIG. 6 is a cut-away sectional view of the connection between the housing of the light fixture shown in FIG. 1 and a side support.

A generally U-shaped casting 44 includes a support axis opening 46 and two bottom indentions for receiving the top ends of pipes 20*a* and 20*b*. Referring to FIG. 6, portion 42 is generally cylindrical or tubular with an end that is externally threaded at threads 48 for securing to an internally threaded opening in the housing. Shoulder 51 is used as a mechanical stop, and can be hexagonally shaped to allow portion 42 to be tightened with a wrench or other utility.

Figure 7:
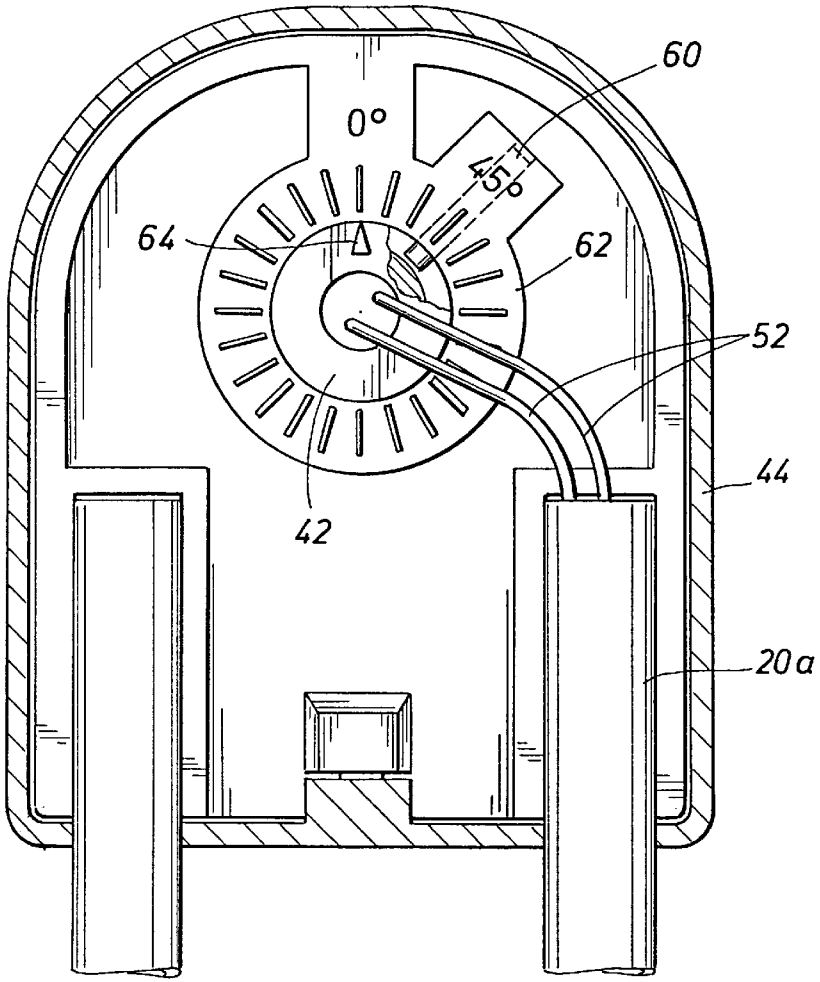
FIG. 7 is an enlarged view of the end of the rotatable axle of the light fixture shown in FIG. 1 with the protective cover removed to permit viewing of the matching indicia showing the degree of housing tilt.

Wiring 52 from the top of pipe 20*a* passes through a connector fitting 54 internal to portion 42, which is embedded in a waterproof insulation material 56. Wiring 52 also passes through tie wrap 78 for strain relief. The outside end of tubular protruding portion 42 includes a peripheral groove 58 into which a safety spring pin 60 is engaged, as shown in FIG. 7. The casting has an axial hub 62 with a hole sized for friction fitting with safety spring pin 60. The friction fitting of the hole prevents safety spring pin 60 from becoming loose. Thus, the pin-and-groove connection allows rotation of the casting with respect to protruding portion 42 while performing the safety function of maintaining the casting onto the protruding portion should set screw 66 become loose, or even fall out.

Referring to FIG. 7, the axle end of protruding portion 42 is shown with an indicia arrow 64 that points to a matching indicia on the casting hub marked "0°" in the drawing. Additional indicia markings on hub 62 are shown at 15° intervals. When protruding portion 42 is axially rotated with respect to hub 62, the housing is rotated therewith. The approximate tilt position will be indicated by the matching indicia of 64 with respect to the indicia on the hub.

To permit axial rotation of housing 14 to occur, a protruding portion 43 from the housing is axially located on the opposite side of the housing from protruding portion 42. A casting 45 attached to the top of pipes 22*a* and 22*b* in a similar fashion to that just described for casting 44 includes a central axial opening in which the protruding portion rotates when the housing is tilted. Thus, the yoke is attached to the housing to permit the desired rotation by establishing an axis of rotation.

A set screw 66 operating with an internally threaded hole in the hub portion of the casting secures the housing at the desirable tilt angle, which may be anywhere within a range from about 0° to 180° in a first direction and from about 0° to 150° in the opposite direction, as shown in FIGS. 2, 3 and 4. FIG. 2 shows light fixture housing 14 at the 0° position, where the light is directed downwardly. FIG. 3 shows a rotation of 180°, where the light is directed straight upwardly. FIG. 4 shows a rotation in the opposite direction of 150°.

Once the amount of tilt has been set and set screw 66 on the side of housing 14 has been advanced to hold the housing at the desired setting, protective cover 68 is put in place over casting 44 and a second set screw 70 is advanced through a threaded hole in the cover into a receiving hole in the casting, as shown in FIG. 6. It should be noted that second set screw 70 further functions as the primary means of securing mounting yoke 16 to housing 14.

It should also be noted that protective cover 68 includes a hole 72 at the top opposite the receiving hole for set screw 66 so that set screw 66 can be loosened to permit resetting of the tilt angle without having to remove protective cover 68. It should also be noted that protective cover 68 satisfies aesthetic requirements to finish the overall look of the fixture.

Referring to FIG. 6, a stop in the form of a screw 74 is shown. This screw extends outside the housing and is engaged by a tab 76 on the backside of casting 44 to prevent the housing from rotating past the 180° position. The tab 76 on the backside of casting 44 also engages screw 74 with an opposite rotation at about 150°. This action is schematically shown in FIGS. 3 and 4, respectively. Alternatively to having only one stop, the housing may have two stops that are positioned to prevent the housing from rotating past the 180° position in the first direction and past the 150° position in the opposite direction. By having such stops, excess twisting of wires 52 is prevented. Strain relief is provided for by tie wraps 30, 78. Alternatively to having screw 74, the housing can have an integral raised section to provide the rotation stop action just described. Another stop structure that can be employed is an externally located washer with a bent tab secured by an external screw.

Although stops have been described as being on the same side where the electrical wiring enters the housing, stops can be located instead, or in addition, on the opposite side of the housing. Likewise, the tilting indicia can be located on the opposite side with respect to protruding portion 43 and a hub built into casting 45 similar to hub 62.

In the preferred embodiment, mounting yoke 16 comprises tubular pipes having internal channels to accommodate wiring. However, any yoke construction having at least one such wiring channel can be employed. Also, hollow post 12 to which the fixture is shown attached has a generally square top or cross section. It is also apparent that a differently shaped mounting post and mounting post top may be employed. So that the mounting yoke can be attached to a post of different configuration to that shown, a mounting fixture in the form of structurally conforming base plate and top plate should be used, but other mounting means known in the art may also suffice.

It is apparent that light fixtures of similar appearance without the rotatable or tilting ability can be used with one or more of the rotatable ones just described to give an overall uniform appearance to the plurality of light fixtures employed together.

While a particular embodiment of the invention has been shown and alternative embodiments have been described, it will be understood that the invention is not limited thereto. Many modifications can be made and will become apparent to those skilled in the art.

What is claimed is:

1. A light fixture for mounting atop a vertical, hollow mounting post carrying electrical wiring from a power source, comprising a housing including a first protruding portion on a first side of said housing, and a second protruding portion on a second side of said housing directly opposite said first protruding portion on said first side to form a rotatable axis, said first protruding portion having an opening for receiving electrical wiring, a mounting yoke including a first support with an axis opening for receiving said first protruding portion projecting from said first side of said housing, and a second support with an axis opening for receiving said second protruding portion from said second side of said housing, and a substantially rigid brace for connecting said first and second supports for common mounting, said brace providing a channel for electrical wiring from the mounting post to said first protruding portion, said housing being tiltable to rotate said axis with respect to said first and second supports, and a means for securing said first and second supports to said housing, and a mounting fixture for attaching said rigid brace of said mounting yoke to the top of the hollow mounting post.

2. A light fixture in accordance with claim 1, wherein said brace of said mounting yoke includes a first pipe accommodating said channel and connecting said first support to said mounting fixture, and a second pipe for connecting said second support to said mounting fixture.

3. A light fixture in accordance with claim 2, wherein said second pipe includes a channel for connecting electrical wiring from the mounting post to said second protruding portion.

4. A light fixture in accordance with claim 1, further comprising a reflector fixedly secured inside the housing and oriented to reflect light in a predetermined pattern, and an electrical connector secured within said reflector for connection to a light source.

5. A light fixture in accordance with claim 4, said connector positioning the elongate axis of the accommodated light source to be non-parallel with said rotatable axis.

6. A light fixture in accordance with claim 1, wherein the end of said first protruding portion is tubular and said first support includes a casting with a first support axis opening that is circular for accommodating said first protruding portion, said first support circular opening and said tubular first protruding portion having matching indicia for indicating the degree of housing tilt with respect to said first support.

7. A light fixture in accordance with claim 1, wherein the end of said second protruding portion is tubular and said second support includes a casting with a second support axis opening that is circular for accommodating said second protruding portion, said second support circular opening and said tubular second protruding portion having matching indicia for indicating the degree of housing tilt with respect to said second support.

8. A light fixture in accordance with claim 1, wherein said brace includes a first curved pipe having its ends respectively fixed to said first and second supports and its center portion attachable to said mounting fixture, said first curved pipe including a wiring opening at its center portion for accommodating electrical wiring from said first curved pipe.

9. A light fixture in accordance with claim 8, wherein said brace includes a second curved pipe having its ends respectively fixed to said first and second supports and its center portion attachable to said mounting fixture, said second curved pipe including a wiring opening at its center portion for accommodating electrical wiring from said second curved pipe.

10. A light fixture in accordance with claim 8 or 9, wherein said mounting fixture includes a base plate adapted to receive electrical wiring from a wiring opening in at least one of said curved pipes, said base plate having an orifice for connecting to electrical wiring in the hollow mounting post.

11. A light fixture in accordance with claim 10, wherein said base plate is adapted to be secured to the hollow mounting post.

12. A light fixture in accordance with claim 1, wherein said first and second supports each includes a threaded hole for receiving a rotation locking set screw for locking said housing at a predetermined tilt angle with respect to said first and second supports.

13. A light fixture in accordance with claim 1, and including first and second covers for respectively covering said first and second supports, said first and second covers being secured to said first and second supports by respective retaining set screws.

14. A light fixture in accordance with claim 1, wherein said housing can be tilted over a range of about 180° in a first direction.

15. A light fixture in accordance with claim 14, wherein said housing can be tilted over a range of about 150° in a second direction opposite from said first direction.

16. A light fixture in accordance with claim 15, and including respective stops for the respective 180° and 150° ranges of tilt.

17. A light fixture in accordance with claim 16, wherein each of said stops comprises a raised section of said first support facing said housing and a metal piece protruding from said housing toward its respective raised section such that each of said respective metal pieces prevents rotation when engaged with its respective raised section.

18. A light fixture in accordance with claim 17, wherein said metal piece is a washer with a bent tab.

19. A light fixture in accordance with claim 17, wherein said metal piece is a screw.

20. A light fixture in accordance with claim 6 or 7, wherein said mounting yoke is secured to said housing by a set screw engaged between a casting cover and said casting on one of said first and second supports and its respective first and second protruding portions.

21. A light fixture in accordance with claim 20, wherein said means for securing said first and second supports to said housing further comprises a spring pin engaged between one of said first and second supports and its first and second protruding portions such that complete disengagement of said set screw does not result in detachment of said first and second supports from said housing.

22. A light fixture in accordance with claim 21, wherein the one of said first and second supports with which said spring pin is engaged includes a groove to permit axial rotation of said housing with respect to said supports.

23. A light fixture in accordance with claim 1, wherein at least one of said first and second protruding portions is removably connected from said housing.

24. A light fixture for mounting atop a vertical, hollow mounting post carrying electrical wiring from a power source, comprising:

a housing including a first protruding portion on a first side of said housing, and a second protruding portion on a second side of said housing directly opposite said first protruding on said first side to form a rotatable axis, said first protruding portion having an opening for receiving electrical wiring, a mounting yoke including a first support with an axis opening for receiving said first protruding portion projecting from said first side of said housing, and a second support with an axis opening for receiving said second protruding portion from said second side of said housing, and a substantially rigid brace for connecting said first and second supports for common mounting, said brace providing a channel for electrical wiring from the mounting post to said first protruding portion, said housing being tiltable to rotate said axis with respect to said first and second supports, and a means for securing said first and second supports to said housing, and a mounting fixture for attaching said rigid brace of said mounting yoke to the top of the hollow mounting post, wherein said housing can be tilted over a range of about 180° in a first direction and about 150° in a second direction opposite from said first direction.

25. The light fixture of claim 24 further comprising respective stops for the respective 180° and 150° ranges of tilt.

26. The light fixture of claim 25 wherein each of said stops comprises a raised section of said first support facing said housing and a metal piece protruding from said housing toward its respective raised section such that each of said respective metal pieces prevents rotation when engaged with its respective raised section.

27. The light fixture of claim 26 wherein said metal piece is a washer with a bent tab.

28. The light fixture of claim 26 wherein said metal piece is a screw.

* * * * *